US008270643B2

(12) United States Patent
Kjems et al.

(10) Patent No.: US 8,270,643 B2
(45) Date of Patent: Sep. 18, 2012

(54) SYSTEM AND METHOD FOR DETERMINING DIRECTIONALITY OF SOUND DETECTED BY AS HEARING AID

(75) Inventors: Ulrik Kjems, Smørum (DK); Michael Syskind Pedersen, Hellerup (DK)

(73) Assignee: Oticon A/S, Smorum (DK)

( * ) Notice: Subject to any disclaimer, the term of this patent is extended or adjusted under 35 U.S.C. 154(b) by 96 days.

(21) Appl. No.: 12/955,626

(22) Filed: Nov. 29, 2010

(65) Prior Publication Data

US 2011/0069851 A1 Mar. 24, 2011

Related U.S. Application Data

(62) Division of application No. 11/245,169, filed on Oct. 7, 2005, now Pat. No. 7,864,971.

(30) Foreign Application Priority Data

Mar. 1, 2005 (EP) ..... 05101561

(51) Int. Cl.
*H04R 25/00* (2006.01)

(52) U.S. Cl. ..... 381/312; 381/313; 381/92; 381/26; 381/309

(58) Field of Classification Search ..... 381/312, 381/313, 26, 92, 309
See application file for complete search history.

(56) References Cited

U.S. PATENT DOCUMENTS

| | | | | |
|---|---|---|---|---|
| 5,638,343 | A | 6/1997 | Ticknor | |
| 5,991,419 | A * | 11/1999 | Brander | 381/312 |
| 2007/0098192 | A1 | 5/2007 | Sipkema | |
| 2008/0044046 | A1 | 2/2008 | Knapp et al. | |

FOREIGN PATENT DOCUMENTS

| | | | |
|---|---|---|---|
| EP | 1 326 478 | A2 | 7/2003 |
| WO | WO 2004/028203 | A2 | 4/2004 |

* cited by examiner

*Primary Examiner* — Vivian Chin
*Assistant Examiner* — Paul Kim
(74) *Attorney, Agent, or Firm* — Birch, Stewart, Kolasch & Birch, LLP

(57) ABSTRACT

This invention relates to a system (200) for determining directionality of a sound. The system (200) comprises a first audio device (202) placed on one side of a user's head (100) and having a first microphone unit (110, 112) for converting said sound to a first electric signal, a second audio device (204) placed on the other side of the user's head (100) and having a second microphone unit (114, 116) for converting said sound to a second electric signal, and comprises a transceiver unit (220, 238) for interconnecting the first and second audio device and communicating the second electric signal to the first audio device (202). The first audio device (202) further comprises a first comparator (222) for comparing the first and second electric signals and generating a first directionality signal from the comparison.

12 Claims, 2 Drawing Sheets

SYSTEM AND METHOD FOR DETERMINING DIRECTIONALITY OF SOUND DETECTED BY AS HEARING AID

This application is a Divisional of application Ser. No. 11/245,169 filed on Oct. 7, 2005 now U.S. Pat. No. 7,864,971, which claims priority to Application No. 05101561.8 filed in EP, on Mar. 1, 2005. The entire contents of all of the above applications is hereby incorporated by reference.

FIELD OF INVENTION

This invention relates to a system and method for determining directionality of sound detected by a hearing aid. In particular, this invention relates to a system and method for improving the determination of directionality throughout the full frequency bandwidth of a hearing device such as behind-the-ear (BTE), in-the-ear (ITE), or completely-in-canal (CIC) hearing aids.

BACKGROUND OF INVENTION

Generally today's hearing aids use a directionality system for determination of directionality of sounds detected by microphones placed on the hearing aids. Normally the directionality is determined by utilising two microphones on each hearing aid, which microphones are separated by a short distance, approximately 1 cm. The registered sounds are converted by the microphones to a first and second electric signal, which are compared. The difference between the first and second electric signal is a function of the location of the sound source, hence, the difference is utilised for selecting an appropriate directionality program in the processor of the hearing aid.

For example, European patent no.: EP 1 174 003 discloses a programmable multi-mode, multi-microphone system for use with a hearing aid. The system allows the user to select between a wide variety of modes or programs such as omni-directional mode, two-microphone directional mode, single-microphone directional mode and a mixed microphone and tele-coil mode.

Further international patent application no.: WO 01/54451 discloses a directional microphone assembly comprising a front and a rear microphone for a hearing aid, and comprising a processor, which generates a directional microphone output signal on the basis of the sound received at the front and rear microphones.

In addition, U.S. Pat. No. 6,778,674 discloses a hearing assist device comprising a first microphone, a second microphone, and circuitry for outputting a processed signal in response to position of sound source.

Neither of the above patent documents, which hereby are incorporated in the below specification by reference, realise and/or solve the problem of the fact that the length of the wavelengths of the lower frequencies are long relative to the distance between two directionality microphones. Generally the distance between the two directionality microphones on a hearing aid is approximately 1 cm. In these circumstances, in particular, the low frequency signals (e.g. smaller than 1000 Hz such as 500 Hz) recorded at each of the directionality microphones are substantially identical, and since the directionality is determined on the basis of difference between the signals of the two directionality microphones, the calculated directionality is mostly based on the high frequency elements of sounds. This problem may obviously be solved by introducing a frequency dependent gain amplifying the low frequency difference signal; however, this generally introduces amplification of noise, which is undesirable. Hence establishing directionality of low frequency signal in the present state of the art is unsatisfactory.

SUMMARY OF THE INVENTION

An object of the present invention is to provide a system and method for determining the directionality of sound detected by a hearing device with an increased accuracy for low frequency sounds.

A particular advantage of the present invention is the provision of a solution which may be implemented in the hearing aid without significant increases in production costs, and the solution avoids amplification of low frequency noise.

A particular feature of the present invention is the provision of a transceiver system having only minor communication requirements since the communication does not require transmission of a full-band signal.

The above object, advantage and feature together with numerous other objects, advantages and features, which will become evident from below detailed description, are obtained according to a first aspect of the present invention by a system for determining directionality of a sound comprising a first audio device adapted to be placed on one side of a user's head and having a first microphone unit adapted to convert said sound to a first electric signal, a second audio device adapted to be placed on the other side of the user's head and having a second microphone unit adapted to convert said sound to a second electric signal, a transceiver unit adapted to interconnect said first and second audio device and to communicate said second electric signal to said first audio device, and wherein said first audio device further comprising a first comparator adapted to compare said first and second electric signals and to generate a first directionality signal from said comparison, a first signal processing unit adapted to process said first electric signal in accordance with said first directionality signal, and a first speaker unit converting said processed first electric signal to a first processed sound.

The term "audio device" is in this context to be construed as a hearing aid, hearing apparatus, hearing device and the like; or a headset, headphones or the like.

The term "first" and "second" is in this context to be construed entirely as a differentiation of devices, i.e. device A and device B. It is not to be construed as limiting in relation to timing, that is, the first audio device is not temporarily before the second audio device and may within the context of this invention be inverted.

The transceiver unit according to the first aspect of the present invention may further be adapted to communicate the first electric signal to the second audio device, and the second audio device may further comprise a second comparator adapted to compare the first and second electric signals and to generate a second directionality signal from the comparison, a second signal processing unit adapted to process the second electric signal in accordance with the second directionality signal, and a second speaker unit converting the processed second electric signal to a second processed sound. Thus each audio device may have the ability to independently determine low and high frequency directionality.

The first microphone unit according to the first aspect of the present invention may comprise a first and second microphone adapted to convert said sound to a first and a second electric sound signal. The first audio unit may further comprise a first filter unit interconnecting the first and second microphone and the transceiver unit, and may be adapted to filter the first and second electric sound signals into a first and second high frequency electric sound signal and into the first electric signal comprising a first low frequency electric sound signal. Thus the first electric signal may consists of a low frequency sound signal recorded at either the first or second microphone in the first audio device on one side of the user's head and transmitted to the second audio device on the other side of the user's head, and hence the distance between the microphones used for determining the directionality of the sound is increased to the width of the user's head. This system significantly improves the determination of directionality of low frequency sound signals since the difference of a low frequency signal received at microphones spaced by 1 cm is considerably increased when received at microphones spaced by the width of the head (the frequencies below 1 kHz have wavelengths larger than 34 cm).

Similarly, the second microphone unit may comprise a third and fourth microphone adapted to convert said sound to a third and fourth electric sound signal. The second audio unit may further comprise a second filter unit interconnecting the third and fourth microphone and the transceiver unit and may be adapted to filter the third and fourth electric sound signals into a third and fourth high frequency electric sound signal and into the second electric signal comprising a second low frequency electric sound signal. As before the distance between the determining microphones is increased to the distance between the first and second audio device, hence an improvement of determination of directionality of low frequency sounds is achieved.

In fact, the first and/or second microphone units may comprise a plurality of microphones adapted to convert the sound to a plurality of electric sound signals and exchange the plurality of electric sound signals with one another.

The first comparator according to the first aspect of the present invention may further be adapted to compare the first and second high frequency electric sound signals to generate a first high frequency directionality signal. The second comparator may further be adapted to compare the third and fourth high frequency electric sound to generate a second high frequency directionality signal. Hence the first and second audio device may generate a first directionality based on low frequency signals received by two audio devices and another directionality signal based on high frequency signals received by one audio device.

The system thereby allows for a low frequency directionality determination based on microphones on both sides of the user's head while it allows for a high frequency directionality determination based on microphones on the same audio device. Hence the system is particularly advantageous since it increases the distance between the microphones which are used for determining directionality of low frequency signals so that the frequency dependent gain can be reduced, and consequently the amplification of the low-frequency noise is reduced.

The transceiver unit according to the first aspect of the present invention may comprise a first transceiver element in the first audio device and a second transceiver element in the second audio device. Further, the first and second transceiver elements may be adapted to communicate through a wireless channel such as an established electro-magnetic coupling. The wireless channel by thus comprise any frequency modulating or coding means known to a person skilled in the art. In a particular embodiment of the present invention the wireless channel is established by inductive coupling. Further, the first and second transceiver elements may be adapted to be paired with one another so as to ensure the communication between the first and second transceiver elements may operate without being disturbed by other audio devices in the vicinity. The person skilled in the art would obviously know that the first and second transceiver elements further may be used for any wireless communication between an electro-magnetic source and the audio device, such electro-magnetic sources as a mobile telephone, FM radio-signals, and Bluetooth equipment.

The first and second transceiver elements according to the first aspect of the present invention may further comprise a sampling unit adapted to sample the first and second low frequency electric sound signals prior to transmission and adapted to de-sample the first and second low frequency electric sound signals subsequent to reception. Hence the communication between the first and second audio devices may be performed without significant load to the communication channel.

The first and second signal processing units according to the first aspect of the present invention may further be adapted to control frequency response, time delay, and gain of the first and second electric signals. The first and second signal processing unit ensures that the user of the audio device is presented with a sound which for example is compensated for a hearing loss.

The above objects, advantages and features together with numerous other objects, advantages and features, which will become evident from below detailed description, are obtained according to a second aspect of the present invention by a method for determining directionality of a sound detected by an audio device, and comprising:

(a) converting a sound to a first electric signal by means of a first audio device,
(b) converting said sound to a second electric signal by means of a second audio device,
(c) communicating said second electric signal to said first audio device by means of a transceiver system,
(d) determining a first directional signal from comparison of said first and second electric signal by means of said first audio device, and
(e) processing said first electric signal in accordance with said first directional signal by means of said first audio device.

The method according to the second aspect of the present invention provides an improved determination of directionality by correlating the first and second electric signal generated on either side of the user of the hearing aid.

The method according to the second aspect of the present invention may incorporate any features of the system according to the first aspect of the present invention.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawing, wherein.

DETAILED DESCRIPTION OF PREFERRED EMBODIMENTS

In the following description of the various embodiments, reference is made to the accompanying figures, which show by way of illustration how the invention may be practiced. It is to be understood that other embodiments may be utilized and structural and functional modifications may be made without departing from the scope of the present invention.

Figure 1:
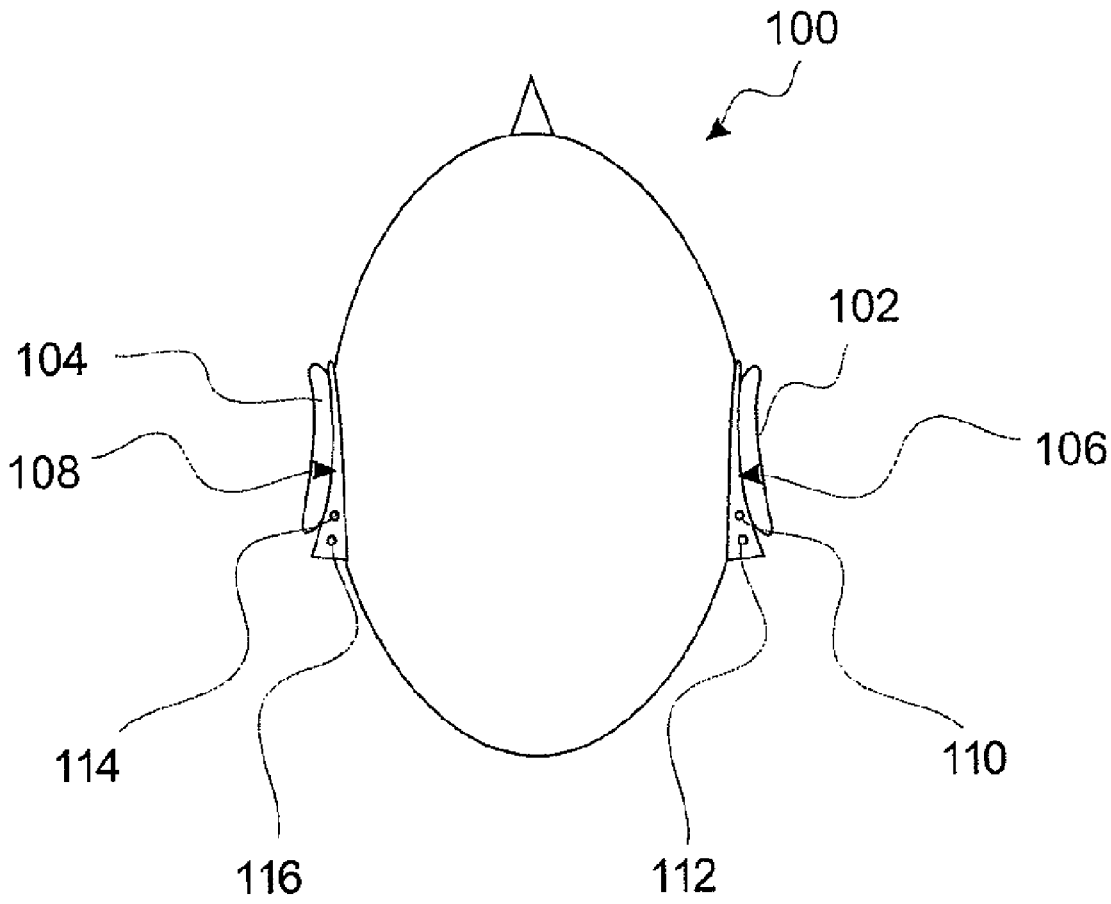
FIG. 1, shows a user having a first and second hearing aid placed behind either ear.

FIG. 1 shows the top of the head of a user 100 with a first ear 102 and a second ear 104 behind each of which is mounted a first hearing aid 106 and a second hearing aid 108, respectively. The first hearing aid 106 comprises a first microphone 110 and a second microphone 112, and the second hearing aid 108 comprises a third microphone 114 and a fourth microphone 116. The first and second microphone 110, 112 converts a sound to a first and second electric sound signal, which each subsequently is high-pass-filtered so as to obtain a first and second high frequency sound signal. The first and second high frequency sound signals are compared with one another in order to generate a first directionality signal. Similarly, the third and fourth microphone 114, 116 converts said sound to a third and fourth electric sound signal, which each subsequently is high-pass-filtered so as to obtain a third and fourth high frequency sound signal. The third and fourth high frequency sound signals are compared with one another in order to generate a second directionality signal.

In addition, to these directionality signals the first hearing aid 106 further comprises a first low-pass-filter for filtering either the first or second electric sound signal achieving a first low frequency sound signal, and the second hearing aid 108 further comprises a second low-pass-filter for filtering the third or fourth electric sound signal achieving a second low frequency sound signal. The first and second low frequency sound signals are subsequently exchanged between the first and second hearing aids 106, 108 each performing a comparison of the first and second low frequency sound signal and each obtaining a further directionality signal there from.

Figure 2:
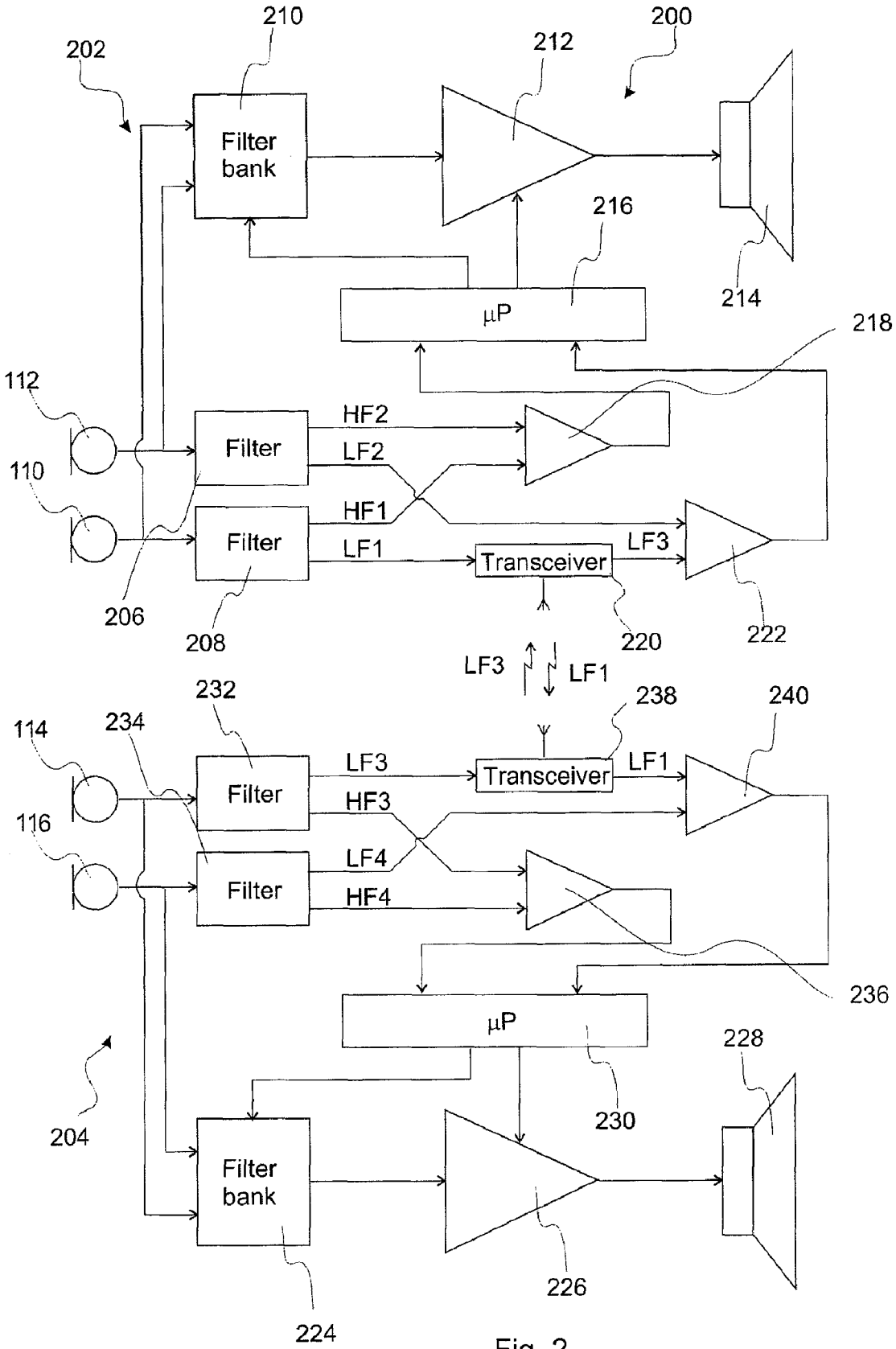
FIG. 2, shows a block diagram of a system for determining directionality of a sound according to a first embodiment of the present invention.

FIG. 2 shows a system designated in entirety by reference numeral 200 and comprising a first and second audio device 202, 204, respectively. The system may be implemented in a wide variety of audio devices such as hearing aids, headsets, headphones and similarly equipment.

The first audio device 202 comprises a first microphone 110 and a second microphone 112 each connecting to a filter 206, 208 and to a filter bank 210. The incoming sound is converted by the first and second microphones 110, 112 and either or both of the converted sounds from the first and/or second microphones 110, 112 is/are communicated to the filter bank 210 and an amplifier 212 for sound processing, and is subsequently communicated to a speaker 214. The filter bank 210 and the amplifier 212 are controlled by a processor 216 so as to, for example, adjust the received sound in accordance with a user's hearing loss. The filter bank 210, the amplifier 212 and the processor 216 may be implemented as a digital signal processing unit.

The filter 206 separates the received signal into a high frequency sound signal HF2 and a low frequency sound signal LF2, and the filter 208, similarly, separates the received signal into a high frequency sound signal HF1 and a low frequency sound signal LF1. The high frequency signals HF1 and HF2 are compared by a comparator 218 generating a high frequency directionality signal for the processor 216. The processor 216 utilises the high frequency directionality signal for selecting an appropriate setting or program for the filter bank 210 and/or amplifier 212. One of the low frequency signals, shown in FIG. 2 as LF1, is forwarded to a transceiver element 220 transmitting LF1 to the second audio device 204 and receiving a low frequency signal LF3 from the second audio device 204. The low frequency signals LF3 and LF2 are compared by a comparator 222 generating a low frequency directionality signal for the processor 216. The processor 216 further utilises the low frequency directionality signal for selecting the appropriate setting or program for the filter bank 210 and/or amplifier 212.

Likewise, the second audio device 204 comprises a filter bank 224 and an amplifier 226 for sound processing a sound converted by third and fourth microphones 114, 116, and a speaker 228 for presenting a processed sound to the user. The second audio device 204 further comprises a 230 for controlling the filter bank 224 and the amplifier 226.

In FIG. 2 the third and fourth microphone 114, 116 are shown to be connected with the filter bank 224, however, in an alternative embodiment only one of the microphones 114, 116 is connected to the filter bank 224.

The third and fourth microphone 114, 116 are further connected to filters 232, 234. The filter 232 separates the received signal into a high frequency sound signal HF3 and a low frequency sound signal LF3 and the filter 234, similarly, separates the received signal into a high frequency sound signal HF4 and a low frequency sound signal LF4. The high frequency signals HF3 and HF4 are compared by a comparator 236 generating a high frequency directionality signal for the processor 230. The processor 230 utilises the high frequency directionality signal for selecting an appropriate setting or program for the filter bank 224 and/or amplifier 226. One of the low frequency signals, shown in FIG. 2 as LF3, is forwarded to a transceiver element 238 transmitting LF3 to the first audio device 202 and receiving a low frequency signal LF1 from the first audio device 202. The low frequency signals LF1 and LF4 are compared by a comparator 240 generating a low frequency directionality signal for the processor 230. The processor 230 further utilises the low frequency directionality signal for selecting the appropriate setting or program for the filter bank 224 and/or amplifier 226.

Hence the system 200 according to the first embodiment of the present invention provides an improved determination of directionality of a sound detected by a microphone unit place on either side of a user.

One of the prerequisites for the system 200 is that the two transceiver elements 220, 238 are able to transmit and receive the low frequency signals LF1, LF3 with a low time delay. A pilot study with speech signals recorded at a head and torso simulator (HATS) show that the localisation effects are maintained if frequency signals larger than 500 Hz are presented binaurally and the frequency signals lower than 500 Hz are presented monaurally (i.e. the same signal is presented to both ears). Listening tests of the recorded speech signals also show that low frequency signals may be delayed up to approximately 20 ms compared to high frequency signals.

For example, only low frequency signals up to 500 Hz, need to be transmitted between the ears, the full-band signal may be low-pass filtered and down-sampled with a 1000 Hz sampling frequency and thus only signals with a sampling frequency of 1000 Hz need to be transmitted between the ears. The un-noticeable delay of 20 ms thus may allow data packages of 16 samples at 1000 Hz to be transmitted.

The invention claimed is:

1. A hearing-aid system for determining directionality of a sound comprising:

a first audio device to be placed on one side of a user's head and having a first microphone unit to convert said sound to a first electric signal;

a second audio device to be placed on the other side of the user's head and having a second microphone unit to convert said sound to a second electric signal, said second electric signal representing a low-frequency sound signal;

a transceiver unit to interconnect said first and second audio device and communicate said third electric signal to said first audio device;

where said first microphone unit includes a first microphone generating a first electric sound signal and a second microphone generating a second electric sound signal;

where said first audio device further includes a first comparator to make a low frequency directionality determination by comparing said first and second electric signals; and generate a first directionality signal representing said low frequency directionality determination; and where said first comparator is further configured to make a high frequency directionality determination by comparing said first and second electric sound signals; and generate a second directionality signal representing said high frequency directionality determination.

2. A system according to claim 1, wherein said first audio device further comprises a first filter unit to filter said first and second electric sound signals into first and second high frequency electric sound signals and into said first electric signal where said first electric signal is a first low frequency electric sound signal, said first filter unit interconnecting said first and second microphones and said transceiver unit.

3. A system according to claim 1, wherein said second microphone unit comprises a third microphone generating a third electric sound signal and a fourth microphone generating a fourth electric sound signal.

4. A system according to claim 3, wherein said second audio device further comprises a second filter unit to filter said third and fourth electric sound signals into third and fourth high frequency electric sound signals and into said second electric signal where said second electric signal is a second low frequency electric sound signal, said second filter unit interconnecting said third and fourth microphones and said transceiver unit.

5. A system according to claim 4, wherein said second audio device further includes a second comparator to make a second high frequency directionality determination by comparing said third and fourth electric sound signals; and generate a third directionality signal representing said second high frequency directionality determination.

6. A system according to claim 1, wherein said transceiver unit comprises a first transceiver element in said first audio device and a second transceiver element in said second audio device.

7. A system according to claim 6, wherein said first and second transceiver elements communicate through a wireless channel such as established electro-magnetic coupling.

8. A system according to claim 2, where said second audio device comprises a third microphone generating a third electric sound signal and a fourth microphone generating a fourth electric sound signal;

said second audio device further comprises a second filter unit to filter said third and fourth electric sound signals into a third and fourth high frequency electric sound signals and into said second electric signal where said second electric signal is a second low frequency electric sound signal;

said second filter unit interconnects said third and fourth microphones and said transceiver unit; and where the transceiver unit includes a sampling unit to sample the first and second low frequency electric sound signals before transmission and de-sample the first and second low frequency electric sound signals after reception.

9. A hearing-aid system comprising:

a first audio device to be placed on one side of a user's head and having a first microphone and a second microphone; and a second audio device to be placed on the other side of the user's head and having a third microphone;

a transceiver unit adapted to interconnect said first and second audio device; and a directionality determination portion to perform a low frequency directionality determination based on a signal from the first microphone and a signal from the third microphone and to perform a high frequency directionality determination based on a signal from the first microphone and a signal from the second microphone.

10. A system according to claim 9, wherein said first audio device further comprises a first filter unit to filter a signal from said first microphone into a first high frequency signal and a first low frequency signal and to filter a signal from said second microphone into a second high frequency signal, said first filter unit interconnecting said first and second microphone and said transceiver unit;

said low frequency directionality determination is performed based on said first low frequency signal and said signal from the third microphone; and said high frequency directionality determination is performed based said first high frequency signal and said second high frequency signal.

11. A system according to claim 10, wherein said second audio device further comprises a fourth microphone and a second filter unit to filter a signal from said third microphone into a third high frequency signal and a second low frequency electric sound signal and to filter a signal from said fourth microphone into a fourth high frequency signal, said second filter unit interconnecting said third and fourth microphone and said transceiver unit;

said low frequency directionality determination is performed based on said first low frequency signal and said second low frequency signal.

12. A system according to claim 11, wherein said directionality determination portion is configured to perform a second high frequency determination based on said third and fourth high frequency signals.

* * * * *